US009987652B2

(12) United States Patent
Qu

(10) Patent No.: US 9,987,652 B2
(45) Date of Patent: Jun. 5, 2018

(54) ADHESIVE FEEDING DEVICE

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventor: Litao Qu, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 112 days.

(21) Appl. No.: 15/256,882

(22) Filed: Sep. 6, 2016

(65) Prior Publication Data

US 2017/0113241 A1 Apr. 27, 2017

(30) Foreign Application Priority Data

Oct. 23, 2015 (CN) ..... 2015 1 0698582

(51) Int. Cl.
*B05C 5/02* (2006.01)
*B05C 7/00* (2006.01)
*B05C 11/10* (2006.01)

(52) U.S. Cl.
CPC ..... *B05C 5/0225* (2013.01); *B05C 11/1007* (2013.01); *B05C 11/1034* (2013.01)

(58) Field of Classification Search
USPC ..... 156/578; 118/300
See application file for complete search history.

(56) References Cited

U.S. PATENT DOCUMENTS 2,033,991 A * 3/1936 Melton ..... B24D 11/005 118/623
2,184,348 A * 12/1939 Kirchner ..... B24D 11/005 101/DIG. 37
2,184,896 A * 12/1939 Oglesby ..... B24D 11/005 51/295
2,254,531 A * 9/1941 Kirchner ..... B24D 11/005 118/623
2,276,328 A * 3/1942 Melton ..... B24D 11/005 118/623
3,799,831 A * 3/1974 Griffiths ..... B23P 15/26 156/297
3,953,056 A * 4/1976 Roberts ..... B29C 53/06 156/212
4,478,669 A * 10/1984 Zeller ..... B23K 13/00 156/379.7
7,371,303 B2 * 5/2008 Schmitt ..... B23P 19/006 156/273.9
9,734,874 B1 * 8/2017 Choe ..... G11B 33/1466
(Continued)

*Primary Examiner* — Sing P Chan
(74) *Attorney, Agent, or Firm* — Nath, Goldberg & Meyer; Joshua B. Goldberg

(57) ABSTRACT

An adhesive feeding device includes an adhesive dripping unit and a magnetic field control unit. The adhesive dripping unit is configured to accommodate an adhesive mixture having magnetic properties and comprises an adhesive outgoing end. The magnetic field control unit is provided above one end of the adhesive dripping unit opposite to the adhesive outgoing end, and is configured to control the adhesive mixture to flow out from the adhesive outgoing end without a firing pin.

16 Claims, 1 Drawing Sheet

(56) References Cited

U.S. PATENT DOCUMENTS

| | | | | |
|---|---|---|---|---|
| 2005/0019529 | A1* | 1/2005 | Fang | A43B 1/00 428/143 |
| 2007/0051718 | A1* | 3/2007 | Schmitt | B23P 19/006 219/635 |
| 2010/0021630 | A1* | 1/2010 | Makover | B05B 7/1486 427/207.1 |
| 2012/0285604 | A1* | 11/2012 | Schmid | B27D 5/003 156/64 |
| 2012/0325915 | A1* | 12/2012 | Kato | H01Q 1/2225 235/492 |
| 2015/0097521 | A1* | 4/2015 | Endou | H01F 27/2804 320/108 |
| 2015/0208560 | A1* | 7/2015 | Baba | H05K 13/0452 361/760 |
| 2016/0310663 | A1* | 10/2016 | Dantsker | A61M 5/14248 |
| 2017/0129130 | A1* | 5/2017 | Schmid | B27D 5/003 |
| 2017/0203464 | A1* | 7/2017 | Compera | B27D 5/003 |

* cited by examiner

ADHESIVE FEEDING DEVICE

CROSS-REFERENCE TO RELATED APPLICATIONS

The present application claims the priority of Chinese Patent Application No. 201510698582.X, filed on Oct. 23, 2015, the contents of which are incorporated herein in their entirety by reference.

TECHNICAL FIELD

The present invention relates to the field of display technology, and in particular, relates to an adhesive feeding device.

BACKGROUND

An organic light-emitting device (OLED), which is a new lighting and display technology, has unique advantages and has been widely adopted. It is a current research subject to improve the performance of the OLED. A packaging process has an important influence on a service life of the OLED, wherein the stability of dripping of a packaging adhesive largely affects the result of the packaging process.

As shown in FIG. 1, a conventional adhesive feeding device includes a storage tank 3 for storing a liquid adhesive, an adhesive dripping unit 1 for dripping the adhesive, and a control unit (e.g., an electromagnet 2) for controlling the adhesive dripping unit 1. The storage tank 3 is connected to the adhesive dripping unit 1 through a transfer tube 4, and the liquid adhesive is transferred from the storage tank 3 to the adhesive dripping unit 1 by introducing $N_2$ (nitrogen gas) into the storage tank 3.

The adhesive dripping unit 1 includes a container 12 for accommodating the liquid adhesive, the container 12 having an opening 13 at one end and a nozzle 11 at the other end, and a connector 14 firmly connected to the opening 13 of the container 12.

The adhesive dripping unit 1 further includes a firing pin 15 provided inside the container 12. The firing pin 15 moves up and down under control of a magnetic field generated from the electromagnet 2, so as to extrude a predetermined amount of the liquid adhesive from the nozzle 11, thereby controlling the dripping of the liquid adhesive.

The electromagnet 2 includes a core 21 and a spiral wire 22 wound around the core 21. As shown in FIG. 1, the electromagnet 2 is located above the adhesive dripping unit 1, and the up-and-down reciprocal movement of the firing pin 15 is controlled by changing a direction of an electric current passing through the spiral wire 22. For example, the electric current passing through the spiral wire 22 may be a square wave current. Further, a speed of the movement of the firing pin 15 may be changed by changing the magnitude of the electric current passing through the spiral wire 22, thereby controlling a speed of the dripping of the liquid adhesive.

During an adhesive dripping process in which an adhesive dripping method is performed by using the conventional adhesive feeding device, a large amount of heat may be generated due to impingement by the firing pin 15, and thus physicochemical parameters such as viscosity and density of the liquid adhesive are degraded, causing a deviation of dripping control to occur. Further, wear of the firing pin 15 and the nozzle 11 is likely to occur, which will increase the maintenance cost.

Moreover, the liquid adhesive in the storage tank 3 is transferred from the storage tank 3 to the container 12 by being applied with pressure using $N_2$. In this case, the instability of the pressure of $N_2$ and the deformation or leakage of the storage tank 3 will cause the transfer of the liquid adhesive to fluctuate and be difficult to control.

SUMMARY

To solve or at least partially solve the above technical problems, the present invention provides an adhesive feeding device.

The adhesive feeding device provided by an embodiment of the present invention includes an adhesive dripping unit and a magnetic field control unit, wherein, the adhesive dripping unit is configured to accommodate an adhesive mixture having magnetic properties and includes an adhesive outgoing end; and the magnetic field control unit is provided above one end of the adhesive dripping unit opposite to the adhesive outgoing end, and is configured to control the adhesive mixture to flow out from the adhesive outgoing end without a firing pin.

Optionally, the magnetic field control unit includes a first magnetic field control sub-unit provided right above the one end of the adhesive dripping unit opposite to the adhesive outgoing end.

Optionally, the adhesive dripping unit includes a container for accommodating the adhesive mixture, and the container includes a nozzle at one end and an opening at the other end.

Optionally, the adhesive dripping unit further includes a connector matching to the opening, and the connector is provided with a transfer tube configured to transfer the adhesive mixture into the container.

Optionally, the first magnetic field control sub-unit includes an electromagnet, and the electromagnet includes a core and a spiral wire wound around the core.

Optionally, the adhesive feeding device further includes a transfer unit for supplying the adhesive mixture to the adhesive dripping unit, wherein, the transfer unit includes a storage sub-unit and a second magnetic field control sub-unit, the storage sub-unit is configured to store the adhesive mixture having magnetic properties, and the second magnetic field control sub-unit is configured to transfer the adhesive mixture from the storage sub-unit to the adhesive dripping unit.

Optionally, the storage sub-unit includes a storage tank which includes a transfer tube provided at an opening end of the storage tank, and the second magnetic field control sub-unit is configured to control the adhesive mixture to transfer from the storage tank to the adhesive dripping unit via the transfer tube.

Optionally, the second magnetic field control sub-unit is provided right above an opening end of the storage tank.

Optionally, the second magnetic field control sub-unit includes an electromagnet, which includes a core and a spiral wire wound around the core.

Optionally, the adhesive mixture includes an adhesive and a magnetic material.

Optionally, a mass percent of the magnetic material to the adhesive mixture ranges from about 1% to about 5%.

Optionally, the magnetic material includes magnetic particles, and each of the magnetic particles has a diameter ranging from about 5 μm to about 10 μm.

Optionally, the magnetic material includes a metal oxide ferrite magnetic material or a rare earth magnetic material.

Optionally, the metal oxide ferrite magnetic material includes $MO_6Fe_2O_3$ or $MOFe_2O_3$.

Optionally, the rare earth magnetic material includes NdFeB.

Optionally, the adhesive feeding device further includes a sensor, wherein, the sensor is connected to the second magnetic field control sub-unit, and configured to detect a level of a liquid adhesive in the adhesive dripping unit and supply a corresponding signal to the second magnetic field control sub-unit, and the second magnetic field control sub-unit controls transfer of the adhesive mixture from the storage tank to the adhesive dripping unit according to the corresponding signal.

The adhesive feeding device provided by the present invention is capable of controlling the transfer and dripping of an adhesive mixture having magnetic properties (e.g., a mixture of an adhesive and a magnetic material) through the magnetic field control unit thereof. The magnetic material can drive the adhesive to move when subjecting to a magnetic field force, and thus stable dripping of the adhesive mixture can be controlled by a magnetic field. The adhesive feeding device does not include a firing pin, so that changes in physicochemical parameters of the adhesive due to the heat generated from impingement by a firing pin, which in turn degrade the stability of the dripping of the adhesive, can be avoided in the dripping of the adhesive. Further, a magnetic field in which magnetic particles are located has a uniform strength, enabling the dripping of the adhesive mixture to be stable.

DETAILED DESCRIPTION OF THE EMBODIMENTS

To enable those skilled in the art to better understand the technical solutions of the present invention, the present invention will be further described in detail below in conjunction with the accompanying drawings and the following embodiments.

Figure 1:
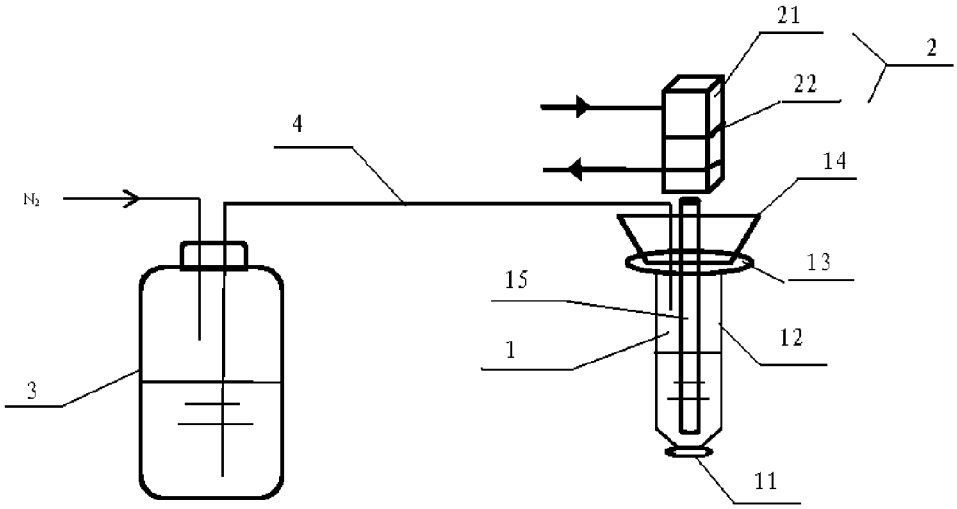
FIG. 1 (Prior Art)
FIG. 1 is a schematic diagram showing a structure of an adhesive feeding device in the prior art.
Figure 2:
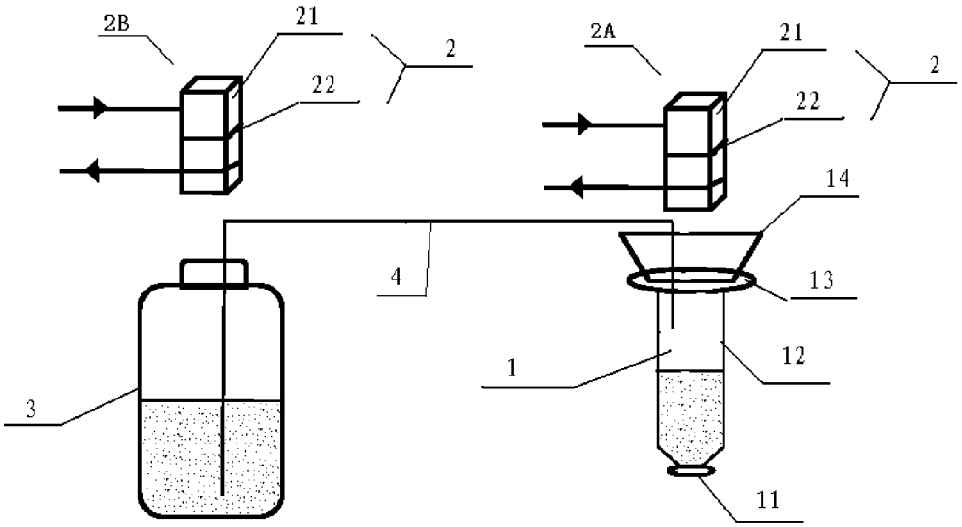
FIG. 2 is a schematic diagram showing a structure of an adhesive feeding device according to an embodiment of the present invention.

As shown in FIG. 2, an embodiment of the present invention provides an adhesive feeding device, which includes an adhesive dripping unit 1 and a magnetic field control unit. The adhesive dripping unit 1 is configured to accommodate an adhesive mixture having magnetic properties, and includes an adhesive outgoing end. The magnetic field control unit is provided above one end of the adhesive dripping unit 1 opposite to the adhesive outgoing end, and is configured to control the adhesive mixture to flow out from the adhesive outgoing end without a firing pin. For example, the magnetic field control unit may include a first magnetic field control sub-unit 2A, which may be provided right above the one end of the adhesive dripping unit 1 opposite to the adhesive outgoing end.

The adhesive feeding device provided by the present embodiment controls the movement of an adhesive mixture having magnetic properties through the magnetic field control unit, so as to control the stable dripping of the adhesive mixture. The adhesive feeding device does not include a firing pin, and changes in physicochemical parameters of the adhesive due to the heat generated from impingement by a firing pin, which in turn degrade the stability of the dripping of the adhesive, can be avoided in the dripping of the adhesive. Further, since the first magnetic field control sub-unit 2A of the magnetic field control unit is provided right above the one end of the adhesive dripping unit opposite to the adhesive outgoing end, an adhesive mixture having magnetic properties accommodated in the adhesive dripping unit 1 is controlled by a magnetic field having a uniform strength, enabling the dripping of the adhesive mixture to be stable.

It should be noted that, a distance between the first magnetic field control sub-unit 2A of the magnetic field control unit and the adhesive dripping unit 1 can be adjusted according to a desired magnitude of magnetic field strength, and is not specifically limited herein.

Optionally, the adhesive dripping unit 1 includes a container 12 for accommodating the adhesive mixture, and the container 12 includes a nozzle 11 at one end (e.g., the lower end as shown in FIG. 2) and an opening 13 at the other end (e.g., an end close to the first magnetic field control sub-unit 2A).

Optionally, the adhesive dripping unit 1 further includes a connector 14 matching to the opening 13, and the connector 14 is provided with a transfer tube 4 configured to transfer the adhesive mixture into the container 12.

Optionally, the first magnetic field control sub-unit 2A of the magnetic field control unit includes an electromagnet 2, and the electromagnet 2 includes a core 21 and a spiral wire 22 wound around the core 21. By introducing an electric current such as a square wave current into the spiral wire 22, and alternately changing a direction of the electric current to alternately change a direction of a magnetic field, the adhesive mixture having magnetic properties is controlled to move up or down. Thus, the adhesive mixture is controlled to drip down or not. Further, by adjusting a period of the electric current such as a square wave current, a frequency of the dripping of the adhesive mixture can be controlled, thereby controlling a dripping amount of the adhesive mixture during a predetermined time period.

Optionally, the adhesive feeding device further includes a transfer unit for supplying the adhesive mixture to the adhesive dripping unit 1, and the transfer unit includes a storage sub-unit and a second magnetic field control sub-unit 2B. The storage sub-unit is configured to store the adhesive mixture having magnetic properties, and the second magnetic field control sub-unit 2B is configured to transfer the adhesive mixture from the storage sub-unit to the adhesive dripping unit 1.

The movement of the adhesive mixture having magnetic properties is controlled by the magnetic field control sub-unit 2B, and thus the transfer of the adhesive mixture can be controlled. In such a way, the following disadvantages of a conventional transfer unit are avoided: the fluctuation and difficulty in control of the transfer of the liquid adhesive, which are caused by the instability of the pressure of $N_2$ and the deformation or leakage of the storage tank 3 since the liquid adhesive in the storage tank 3 must be transferred from the storage tank 3 to the container 12 by being applied with pressure using $N_2$.

Optionally, the storage sub-unit includes a storage tank 3 which includes a transfer tube 4 provided at an opening end of the storage tank 3, and the second magnetic field control sub-unit 2B is configured to control the adhesive mixture to transfer from the storage tank 3 to the adhesive dripping unit 1 via the transfer tube 4.

It should be noted that, the transfer tube 4 provided at an opening end of the storage tank 3 and the transfer tube 4 provided at the connector 14 may be a same transfer tube, or may be different transfer tubes. In a case where they are different transfer tubes, they may be firmly connected to each other by a tube connector.

Optionally, the second magnetic field control sub-unit 2B is provided right above an opening end of the storage tank 3. It should be noted that, by providing the second magnetic field control sub-unit 2B right above the opening end of the storage tank 3, the adhesive mixture having magnetic properties in the storage tank 3 is controlled by a magnetic field having a uniform strength, and a direction of the magnetic field is easy to be controlled. Further, a distance between the second magnetic field control sub-unit 2B and the storage tank 3 can be adjusted according to a desired magnitude of magnetic field strength, and is not specifically limited herein.

Optionally, the second magnetic field control sub-unit 2B includes an electromagnet 2, which includes a core 21 and a spiral wire 22 wound around the core 21.

By introducing an electric current into the spiral wire 22 of the second magnetic field control sub-unit 2B, and changing a direction of the electric current to change a direction of a magnetic field, the adhesive mixture having magnetic properties is controlled to move up or down. Thus, the adhesive mixture is controlled to be transferred or not. Further, by changing a magnitude of the electric current passing through the spiral wire 22 of the second magnetic field control sub-unit 2B, a transfer speed of the adhesive mixture can be controlled.

Here, the adhesive feeding device may further include a sensor (not shown). The sensor is connected to the second magnetic field control sub-unit 2B, and configured to detect a level of the liquid adhesive in the container 12 and supply a corresponding signal to the second magnetic field control sub-unit 2B. It should be noted that, introduction of an electric current into the spiral wire 22 of the magnetic field control sub-unit 2B can be controlled according to the corresponding signal obtained by detecting a level of the liquid adhesive in the container 12, that is, the transfer of the adhesive mixture having magnetic properties from the storage tank 3 to the adhesive dripping unit 1 can be controlled according to the corresponding signal obtained by the sensor detecting a level of the liquid adhesive in the adhesive dripping unit 1.

Optionally, the adhesive mixture having magnetic properties includes an adhesive and a magnetic material.

Since the adhesive mixture is a mixture including an adhesive and a magnetic material, the magnetic material can drive the adhesive to move when subjecting to a magnetic field force, and thus stable transfer and stable dripping of the adhesive mixture can be controlled by a magnetic field.

It should be noted that, it is better that an adhesive force between the adhesive and the magnetic material is larger, and in particular, the adhesive force therebetween can be increased by controlling a density of the magnetic material and a viscosity of the adhesive. In general, the smaller the density of the magnetic material and the larger the viscosity of the adhesive, the larger the adhesive force. The larger adhesive force between the adhesive and the magnetic material has the following two advantages: one is that the magnetic material as a whole is prevented from gathering towards one direction during dotting and adhesive feeding, the gathering towards one direction degrading the effect of dotting and adhesive feeding, and the other is that both the magnetic material and the adhesive can be uniformly distributed on a substrate such as a glass substrate.

Further, the magnetic material may serve as a filler to maintain the stability of upper and lower substrates.

Optionally, a mass percent of the magnetic material to the adhesive mixture ranges from about 1% to about 5%. It should be noted that, the mass percent of the magnetic material to the adhesive mixture can be set according to desired adhesive force between the adhesive and the magnetic material.

Optionally, the magnetic material includes magnetic particles, and each of the magnetic particles has a diameter ranging from about 5 μm to about 10 μm. It should be noted that, the smaller the diameter of each of the magnetic particles, the easier the control of the movement of the adhesive mixture. However, a magnetic particle having a too small diameter is not suitable for being used as a filler.

Optionally, the magnetic material includes a metal oxide ferrite magnetic material or a rare earth magnetic material. Such a magnetic material has a larger elasticity, and thus is suitable for being used as a filler.

Optionally, the metal oxide ferrite magnetic material includes $MO_6Fe_2O_3$ or $MOFe_2O_3$. Optionally, the rare earth magnetic material includes NdFeB. It should be noted that, other materials may be adopted according to a practical application, as long as they are easy to be controlled, suitable for being used as fillers, and have a larger adhesive force with the adhesive.

It should be understood that, the foregoing embodiments are only exemplary embodiments used for explaining the principle of the present invention, but the present invention is not limited thereto. Various variations and improvements may be made by a person of ordinary skill in the art without departing from the spirit and essence of the present invention, and these variations and improvements also fall within the protection scope of the present invention.

What is claimed is:

1. An adhesive feeding device, comprising an adhesive dripping unit and a magnetic field control unit, wherein, the adhesive dripping unit is configured to accommodate an adhesive mixture having magnetic properties and comprises an adhesive outgoing end; and the magnetic field control unit is provided above one end of the adhesive dripping unit opposite to the adhesive outgoing end, and is configured to control the adhesive mixture to flow out from the adhesive outgoing end without a firing pin.

2. The adhesive feeding device according to claim 1, wherein, the magnetic field control unit comprises a first magnetic field control sub-unit provided right above the one end of the adhesive dripping unit opposite to the adhesive outgoing end.

3. The adhesive feeding device according to claim 2, wherein, the first magnetic field control sub-unit comprises an electromagnet, and the electromagnet comprises a core and a spiral wire wound around the core.

4. The adhesive feeding device according to claim 2, further comprising a transfer unit for supplying the adhesive mixture to the adhesive dripping unit, wherein, the transfer unit comprises a storage sub-unit and a second magnetic field control sub-unit, the storage sub-unit is configured to store the adhesive mixture having magnetic properties, and the second magnetic field control sub-unit is configured to transfer the adhesive mixture from the storage sub-unit to the adhesive dripping unit.

5. The adhesive feeding device according to claim 4, wherein, the storage sub-unit comprises a storage tank which comprises a transfer tube provided at an opening end of the storage tank, and the second magnetic field control sub-unit is configured to control the adhesive mixture to transfer from the storage tank to the adhesive dripping unit via the transfer tube.

6. The adhesive feeding device according to claim 5, further comprising a sensor, wherein, the sensor is connected to the second magnetic field control sub-unit, and configured to detect a level of a liquid adhesive in the adhesive dripping unit and supply a corresponding signal to the second magnetic field control sub-unit, and the second magnetic field control sub-unit controls transfer of the adhesive mixture from the storage tank to the adhesive dripping unit according to the corresponding signal.

7. The adhesive feeding device according to claim 4, wherein, the second magnetic field control sub-unit is provided right above an opening end of the storage tank.

8. The adhesive feeding device according to claim 4, wherein, the second magnetic field control sub-unit comprises an electromagnet, which comprises a core and a spiral wire wound around the core.

9. The adhesive feeding device according to claim 1, wherein, the adhesive dripping unit comprises a container for accommodating the adhesive mixture, and the container comprises a nozzle at one end and an opening at the other end.

10. The adhesive feeding device according to claim 9, wherein, the adhesive dripping unit further comprises a connector matching to the opening, and the connector is provided with a transfer tube configured to transfer the adhesive mixture into the container.

11. The adhesive feeding device according to claim 1, wherein, the adhesive mixture comprises an adhesive and a magnetic material.

12. The adhesive feeding device according to claim 11, wherein, a mass percent of the magnetic material to the adhesive mixture ranges from about 1% to about 5%.

13. The adhesive feeding device according to claim 11, wherein, the magnetic material comprises magnetic particles, and each of the magnetic particles has a diameter ranging from about 5 μm to about 10 μm.

14. The adhesive feeding device according to claim 11, wherein, the magnetic material comprises a metal oxide ferrite magnetic material or a rare earth magnetic material.

15. The adhesive feeding device according to claim 14, wherein, the metal oxide ferrite magnetic material comprises $MO_6Fe_2O_3$ or $MOFe_2O_3$.

16. The adhesive feeding device according to claim 14, wherein, the rare earth magnetic material comprises NdFeB.

* * * * *